US005219624A

United States Patent [19]

Kiapos et al.

[11] Patent Number: 5,219,624

[45] Date of Patent: Jun. 15, 1993

[54] DECORATIVE MULTI-BEAD TASSEL

[76] Inventors: John Kiapos, 9161 La Tuna Canyon Rd.; Dennis R. Lotz, 9145 La Tuna Canyon Rd., both of Sun Valley, Calif. 91352

[21] Appl. No.: 814,711

[22] Filed: Dec. 30, 1991

[51] Int. Cl.[5] ..... A44C 11/00

[52] U.S. Cl. ..... 428/28; 24/116 A; 63/2

[58] Field of Search ..... 63/2, 4, 1.1; 223/46; 428/28, 7; 24/116 A

[56] References Cited

U.S. PATENT DOCUMENTS

| | | | |
|---|---|---|---|
| 1,412,731 | 4/1922 | Wormser | 63/2 |
| 1,425,336 | 8/1922 | Prevot | 428/28 X |
| 1,692,649 | 11/1928 | Goodridge et al. | 63/2 X |
| 1,740,992 | 12/1929 | McCretton | 63/2 |
| 1,781,687 | 11/1930 | Hazman | 428/28 |
| 2,234,835 | 3/1941 | Sexton | 428/11 |
| 3,549,465 | 12/1970 | Skelley, Jr. | 428/11 |
| 4,377,078 | 3/1983 | Block | 63/2 |
| 4,527,316 | 7/1985 | Murphy | 24/116 A |
| 4,952,432 | 8/1990 | Wolde | 428/40 |
| 4,988,542 | 1/1991 | Kiapos et al. | 427/171 X |

*Primary Examiner*—Henry F. Epstein
*Attorney, Agent, or Firm*—Beehler & Pavitt

[57] ABSTRACT

A decorative bead chain tassel formed by providing at least three bead chains about a suspended center strand of bead chain with the first bead of each of surrounding chains being seated between beads of the center strand and held in such disposition by encircling securing means.

10 Claims, 1 Drawing Sheet

DECORATIVE MULTI-BEAD TASSEL

FIELD OF THE INVENTION

This invention relates to the field of decorative items in general and decorative bead or shot chain in particular.

DESCRIPTION OF THE PRIOR ART

In recent years, considerable interest has been generated in decorative bead or shot chain, particularly since the advent of the novel method of rendering such chain decorative has been developed as disclosed in U.S. Pat. No. 4,988,542 issued Jan. 29, 1991. Numerous uses have been and are being found for such chain as, for example, for curtains, necklaces and other body adornments, eyeglass retainers, etc.

Hitherto, strands of such shot or bead chain have either been interconnected between two elements or, when hung free, have hung as single strands. While such decorative strands are appealing, improvements in the decorative designs for such strands are continually being sought.

SUMMARY OF THE INVENTION

The present invention provides an improved ending for strands of decorative bead or shot chain in the form of a tassel-type arrangement. This arrangement involves the use of a center strand of shot or bead chain about which are equiangularly disposed a plurality of similar chains which are, in effect, offset axially by a half bead length below the center strand.

Both the center and peripherally disposed plurality of similar chains are secured together either by some type of wire or other wrapping, a clamp or by a quick setting adhesive. After the chains are thus secured together by one means or another, the top bead of the center strand may then be joined by some type of clamping means to the free end of another chain or to any other type of elongated element which is also held by the clamping means. What then appears is a bead chain tassel extending down from the elongated element or other device supporting the clamping means which holds the top bead of the center strand referred to above. With the peripheral chain colored in one manner or another, each of a single color or multi-colored, as taught in U.S. Pat. No. 4,988,542, the tassel presents an appealing appearance.

DESCRIPTION OF THE DRAWINGS

In the accompanying drawings.

DESCRIPTION OF THE PREFERRED EMBODIMENT

Figure 1:
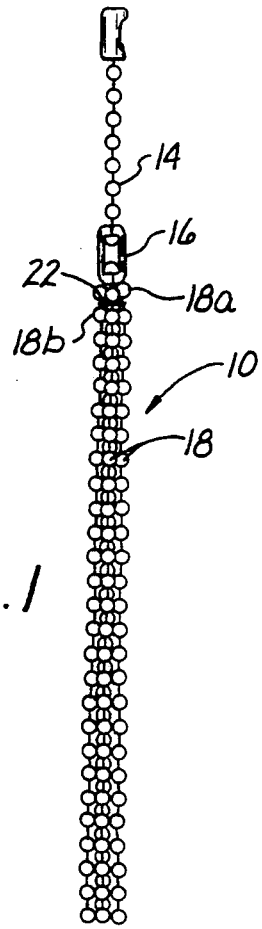
FIG. 1 is a side elevation of a tassel clampingly attached to a single bead chain.

Referring to FIG. 1, a tassel 10, formed in the manner hereinafter described, is attached to the free end 12 (FIG. 2) of a single bead or shot chain 14 by a clamp 16. The tassel 10 is constructed by providing a plurality of peripheral shot or bead chains 18 about a center strand 20 of bead chain, with the top beads 18*a* being disposed between the first and second beads 20*a* and 20*b*, respectively, of the center strand 20 so that, in effect, the peripheral strands 18 are aligned one half bead below the beads 20*a*, 20*b*, etc. of the center strand 20. The top beads 20*a*, 20*b* of the center strand 20 and the top beads 18*a*, 18*b* of peripheral strands 18 may be secured in such disposition by a wire or other strong filament wrapping 22 which extends around the peripheral chains 18 and between their upper beads 18*a* and 18*b*. The wrapping 22 thus holds each of the peripheral beads 18*a* in the interstice 24 between the beads 20*a* and 20*b* of the center strand 20, and also holds the peripheral beads 18*b* in the interstice 25 between the center strand beads 20*b* and 20*c*. Thus secured, the remaining beads 18*c* . . . . 18*x* will all hang together about the center strand 20, thereby presenting the appearance of a bead chain tassel 10.

Figure 4:
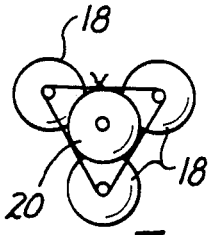
FIG. 4 is a section similar to FIG. 3, but showing a lesser number of peripheral chains secured by wire wrap.

In the embodiments shown in FIGS. 1–3 and 5 peripheral chains 18 are provided about the center strand 20, so that each chain 18 is disposed at a 72 degree angle about the perpendicular axial filament 28 through the center strand beads 20. It should be appreciated, however, that as shown in FIG. 4, a lesser number of peripheral strands 18 (e.g. three or four) could be employed.

Figure 5:
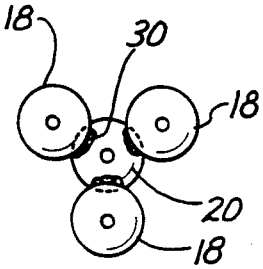
FIG. 5 is a section similar to FIG. 4, but showing the peripheral chains secured to the center strand by adhesive.
Figure 6:
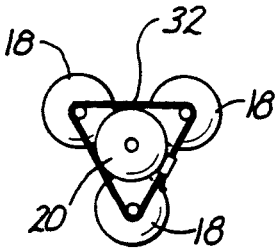
FIG. 6 is a view similar to FIG. 4, but showing the peripheral strands secured to the center strand by a clamp.

While the embodiments shown in FIGS. 1–4 inclusive utilize a wire or filament wrapping 22 to secure the top beads 18*a* and 18*b* about the center strand 20, it would also be possible to effect such disposition by means of an adhesive 30 as shown in FIG. 5 or some type of encircling clamp 32 as shown in FIG. 6.

Figure 2:
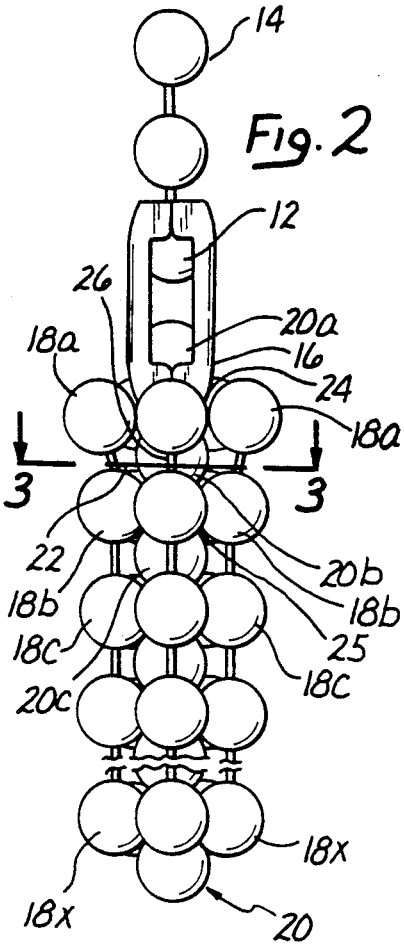
FIG. 2 is an enlarged view of the upper end of the tassel of FIG. 1 with the clamp.
Figure 3:
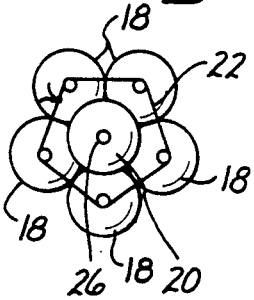
FIG. 3 is a section taken on the line 3—3 of FIG. 3.
Figure 7:
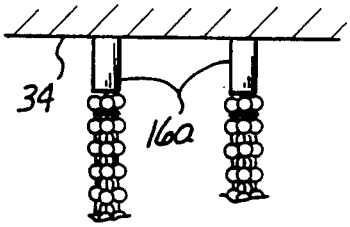
FIG. 7 is a partial view similar to FIG. 1 showing a tassel clamped to a horizontal surface.

Further, while the embodiment shown in FIG. 1 provides for the clamping of the tassel 10 to the free end 12 of another chain 14, it will be readily understood that the tassel heretofore described could be attached by the clamping head 16 to any surface or structure 34 having clamping grips 16*a* which may be brought about the top bead 20*a* of the center strand 20, in the manner illustrated in FIG. 2 and heretofore described, as shown in FIG. 7.

From the illustrations and explanation set forth above, it may be seen that a decorative shot or bead chain tassel may be provided for many different applications.

We claim:

1. A decorative bead chain tassel comprising:

(a) An elongated element, said element having a downwardly extending free end;

(b) A first strand of a downwardly pending bead chain, said strand being of a predetermined length and comprised of a plurality of beads of a predetermined spherical size strung together in series from a first strand end to a second strand end;

(c) At least three second strands of a downwardly pending bead chains, each also being of a predetermined similar length, and comprised of a plurality of beads of a predetermined size and strung together in series from a first strand end to a second strand end, said second strands being disposed equiangularly about the first strand with the first end of each of said second strands being inserted between the first and second beads at the first bead of the first strand;

(d) Means securing said first beads in the second strands in said disposition between said first and second beads in the first strand; and (e) Means to secure the first end of the first strand to the free end of said elongated element.

2. A decorative bead chain tassel as described in claim 1 wherein all of the bead chain strands are of bead shot.

3. A decorative bead chain tassel as described in claim 1 wherein the second strands number five.

4. A decorative bead chain tassel as described in claim 1 wherein the means securing the first beads int he second strands in their disposition between the first and second beads of the first strand comprises a wire wrapping.

5. A decorative bead chain tassel as described in claim 1 wherein the means securing the first beads in the second strands in their disposition between the first and second beads of the first strand comprises a clamp.

6. A decorative bead chain tassel as described in claim 1 wherein the means securing the first beads in the second strands in their disposition between the first and second beads of the first strand comprises an adhesive.

7. A decorative bead chain tassel as described in claim 1 wherein the elongated element is itself a bead chain.

8. A decorative bead chain tassel as described in claim 7 wherein the means securing the first end of the first strand to the free end of the elongated bead chain element is a clamp.

9. A decorative bead chain tassel comprising:

(a) a first strand of a downwardly pending bead chain, said strand being of a predetermined length and comprised of a plurality of beads of a predetermined spherical size strung together in series from a first strand end to a second strand end;

(b) At least three second strands of a downwardly pending bead chain, each also being of a predetermined similar length, and comprised of a plurality of beads of a predetermined size and strung together in series from a first strand end to a second strand end, said second strands being disposed equiangularly about the first strand with the first bead of each of said second strands being inserted between the first and second beads at the first end of the first strand;

(c) Means securing said first beads in the second strands in said disposition between said first and second beads in the first strand; and (d) Means to secure the first end of the first strand in a pendant position.

10. A decorative bead chain tassel comprising:

(a) A first strand of a downwardly pending bead chain, said strands being of a predetermined length and comprised of a plurality of beads of a predetermined spherical size strung together in a series from a first strand end to a second strand end;

(b) At least three second strands of a downwardly pending bead chain, each also being of a predetermined similar length, and comprised of a plurality of beads of a size similar to that of said first strand and strung together in series from a first strand end to a second strand end, said second strands being disposed equiangularly about the first strand with the first bead of each of said second strands being inserted between the first and second beads at the first end of the first strand;

(c) Means securing said first beads in the second strands in said disposition between said first and second beads in the first strand; and (d) Means to secure the first end of the first strand in a pendant position.

* * * * *